United States Patent [19]

Johnston et al.

[11] 3,982,553

[45] Sept. 28, 1976

[54] VACUUM REDUCER VALVE ASSEMBLY

[75] Inventors: Daniel U. Johnston; Robert L. Larson, both of Anderson, Ind.

[73] Assignee: General Motors Corporation, Detroit, Mich.

[22] Filed: Nov. 28, 1975

[21] Appl. No.: 635,862

[52] U.S. Cl. ..... 137/81; 123/117 A; 137/103

[51] Int. Cl.[2] ..... F02P 5/14

[58] Field of Search ..... 137/102, 103, DIG. 8, 137/81; 123/117 A

[56] References Cited

UNITED STATES PATENTS

| | | | |
|---|---|---|---|
| 3,797,512 | 3/1974 | Martin | 123/117 A |
| 3,828,743 | 8/1974 | Ludwig | 123/117 A |
| 3,933,166 | 1/1976 | Gould | 137/102 |

*Primary Examiner*—Robert G. Nilson
*Attorney, Agent, or Firm*—C. K. Veenstra

[57] ABSTRACT

A vacuum reducer valve assembly senses the engine induction passage vacuum and delivers a reduced vacuum signal to a vacuum motor which advances the ignition timing in proportion to the vacuum signal. The vacuum reducer valve assembly has a member which decreases the difference between the induction passage vacuum and the reduced vacuum signal as atmospheric pressure decreases.

3 Claims, 1 Drawing Figure

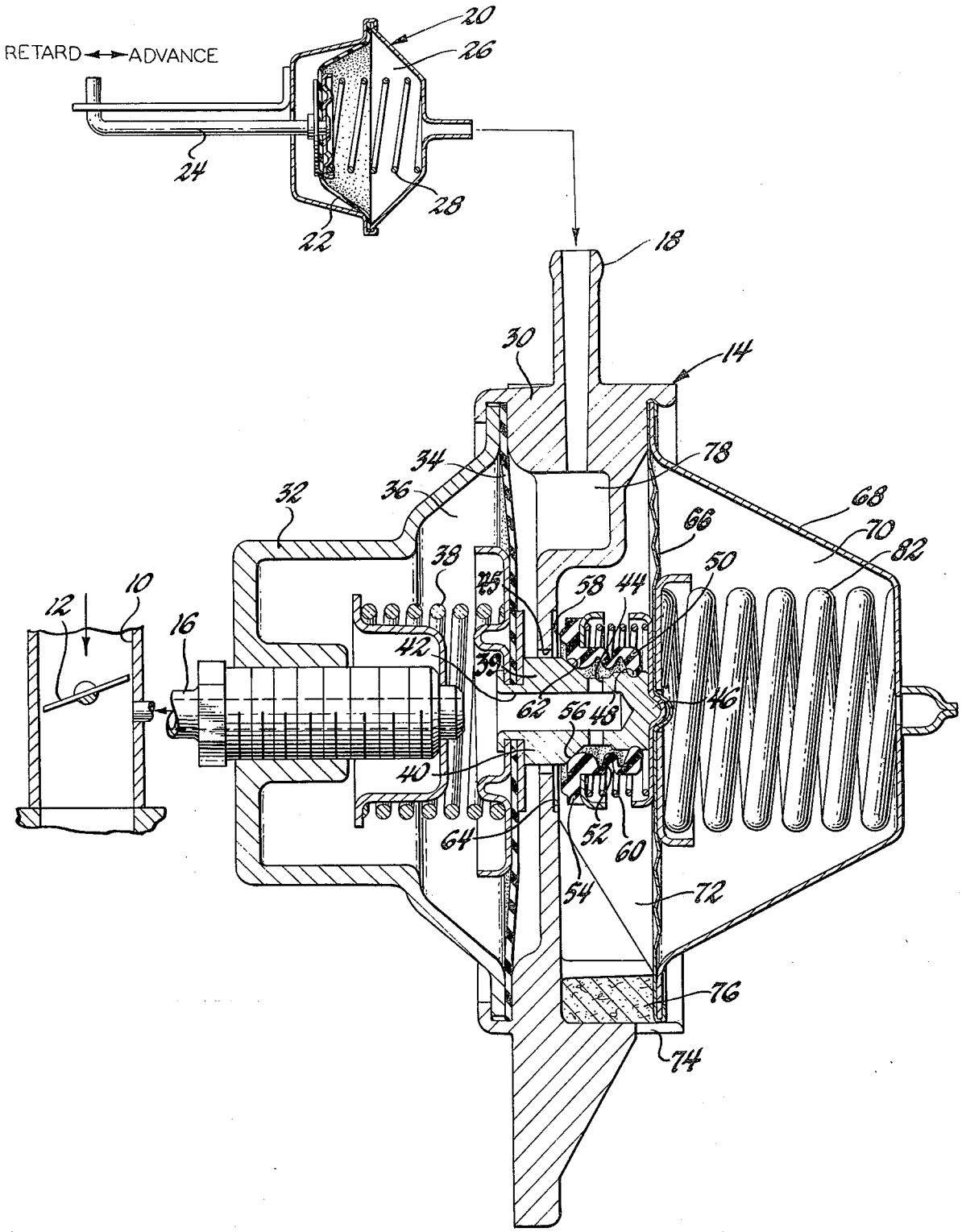
RETARD ← → ADVANCE
20
26
24
28
22
18
30
14
34
78
36
32
68
66
70
82
38
50
12
10
16
42
58
44
39
62
56
48
46
40
64
52
60
54
72
76
74

VACUUM REDUCER VALVE ASSEMBLY

This invention relates to a vacuum reducer valve assembly which has particular advantage for use in an internal combustion engine ignition timing control system.

It is common practice to vary engine ignition timing as a function of engine induction passage vacuum. In some applications, however, it has been desired to employ a reduced vacuum signal in place of the full induction passage vacuum. Systems operating in this manner are shown in U.S. Pat. No. 3,797,512 Martin, issued Mar. 19, 1974 and in the Feb. 15, 1975 issue of Automotive Industries, page 56.

This invention provides a vacuum reducer valve assembly which may sense induction passage vacuum and which delivers a vacuum signal reduced a selected amount from the sensed vacuum. In addition, this vacuum reducer valve assembly is adapted to employ an ambient pressure responsive member which varies the difference between the sensed vacuum and the reduced vacuum signal as atmospheric pressure varies.

The details as well as other objects and advantages of this invention are set forth in the following detailed description and are shown in the drawing which illustrates this vacuum reducer valve assembly, in an axial sectional view, connected between an engine induction passage and an ignition vacuum advance motor.

Referring to the drawing, an internal combustion engine induction passage 10 has a throttle 12 for controlling air flow to the combustion chambers. A vacuum reducer valve assembly 14 has a fitting 16 connected to induction passage 10 downstream of throttle 12 and a fitting 18 connected to an ignition system vacuum advance motor 20.

Vacuum motor 20 includes a diaphragm 22 carrying a plunger 24 which may be connected to the engine ignition distributor (not shown) to vary the ignition timing. As an increasing vacuum signal is applied to chamber 26 in vacuum motor 20 (i.e., as the pressure in chamber 26 decreases), diaphragm 22 is pulled rightwardly against the bias of a spring 28 and plunger 24 advances the ignition timing. As the vacuum signal applied to chamber 26 decreases (i.e., as the pressure in chamber 26 increases), spring 28 pushes diaphragm 22 and plunger 24 leftwardly to retard the ignition timing.

Vacuum reducer valve assembly 14 has a central housing 30 and a left-hand cover 32 secured around an operating diaphragm 34. A source vacuum chamber 36, defined between cover 32 and diaphragm 34, senses the vacuum in induction passage 10 through fitting 16, and the consequent decrease in pressure in chamber 36 pulls diaphragm 34 leftwardly against the bias of a spring 38.

Diaphragm 34 carries one end 39 of a plunger 40 which has a central passage 42 and one or more lateral ports 44. Plunger 40 projects through a central aperture 45 in housing 30, and its other end 46 has a peripheral groove 48 receiving one end 50 of a cylindrical, axially flexible boot 52. The other end 54 of boot 52 has inner and outer circular valve surfaces 56 and 58 respctively. A spring 60 biases inner valve surface 56 toward a conical valve seat 62 formed on plunger 40 and outer valve surface 58 toward a flat valve seat 64 formed on housing 30 about aperture 45.

On the right-hand side. a pressure responsive member 66 may be secured between housing 30 and a closure member 68 to engage end 46 of plunger 40, and a chamber 70 defined between pressure responsive member 66 and closure member 68 may be evacuated while a chamber 72 defined between housing 30 and pressure responsive member 66 is open to the atmosphere through a window 74. A pad of filter material 76 is disposed across window 74 to exclude dirt from valve assembly 14.

In operation, as operating diaphragm 34 is moved leftwardly by the induction passage vacuum in source vacuum chamber 36, plunger 40 is moved leftwardly to engage outer valve surface 58 with housing valve seat 64 and to disengage inner valve surface 56 from plunger valve seat 62. The induction passage vacuum is then applied through bore 42 and openings 44 to the reduced vacuum chamber 78 defined between housing 30 and operating diaphragm 34. When the vacuum in reduced vacuum chamber 78 increases to a selected amount below the vacuum in source vacuum chamber 36 (for example, when the vacuum in chamber 78 is 6 inches Hg below the vacuum in chamber 36, or the pressure in chamber 78 is 6 inches Hg above the pressure in chamber 36, at an altitude of 1000 feet above sea level), spring 38 moves operating diaphragm 34 and plunger 40 rightwardly to just engage plunger valve seat 62 with inner valve surface 56 while outer valve surface 58 remains in engagement with housing valve seat 64. Thereafter, should the induction passage vacuum in chamber 36 increase, operating diaphragm 34 and plunger 40 will be moved leftwardly to disengage plunger valve seat 62 from inner valve surface 56 and thus increase the vacuum signal in chamber 78, while if the induction passage vacuum in chamber 36 should decrease, spring 38 will move operating diaphragm 34 and plunger 40 rightwardly to disengage outer valve surface 58 from housing valve seat 64 and permit air to flow from chamber 72 through central housing aperture 45 into chamber 78 and thus decrease the vacuum signal therein. Vacuum reducer valve assembly 14 thereby maintains the vacuum signal in reduced vacuum chamber 78 a selected amount below the induction passage vacuum in source vacuum chamber 36. It will be noted that the bias of spring 38 and thus the difference between induction passage vacuum and the reduced vacuum signal may be adjusted by turning the screw-threaded fitting 16, the bias and the difference increasing as the fitting is turned in and decreasing as the fitting is turned out.

As the ambient atmospheric pressure in atmospheric pressure chamber 72 decreases with increasing altitude, pressure responsive member 66 is urged leftwardly by a spring 82 to increasingly oppose the bias of spring 38. The net decrease in the rightward bias on operating diaphragm 34 decreases the difference between induction passage vacuum in source vacuum chamber 36 and the reduced vacuum signal in chamber 78. At an elevation of, for example, 9000 feet above sea level, the pressure responsive member 66 and spring 82 will totally oppose the bias of spring 38 so that outer valve surface 58 continuously engages housing valve seat 64 and the vacuum signal in chamber 78 is equal to the vacuum in chamber 36.

It will be appreciated, of course, that the vacuum signal in chamber 78 is applied through fitting 18 to vacuum advance motor 20. When pressure responsive member 66 is employed, valve assembly 14 provides altitude compensation of ignition vacuum advance. For example, in place of a vacuum motor which would, at an altitude of 1000 feet above sea level, otherwise initiate vacuum advance at 8 inches Hg induction passage vacuum and provide full vacuum advance at 12 inches Hg induction passage vacuum, vacuum motor 20 would initiate vacuum advance at a 2 inch Hg vacuum signal and provide full vacuum advance at a 6 inch Hg vacuum signal while vacuum reducer valve assembly would be set to reduce induction passage vacuum 6 inches Hg. The effect of valve assembly 14 and vacuum motor 20 would be to initiate vacuum advance at 8 inches Hg induction passage vacuum and provide full vacuum advance at 12 inches Hg induction passage vacuum at a 1000 foot altitude, to initiate vacuum advance at 5 inches Hg induction passage vacuum and provide full vacuum advance at 9 inches Hg induction passage vacuum at a 5000 foot altitude, and to initiate vacuum advance at 2 inches Hg induction passage vacuum and provide full vacuum advance at 6 inches Hg induction passage vacuum above a 9000 foot altitude. In many cases, it may be desired to also employ an aneroid on vacuum motor 20 to change initial timing with altitude.

The embodiments of the invention in which an exclusive property or privilege is claimed are defined as follows:

1. A vacuum reducer valve assembly comprising a housing, a cover, a diaphragm secured between said housing and said cover to define a source vacuum chamber between said cover and one side of said diaphragm and to define a reduced vacuum chamber between the opposite side of said diaphragm and one side of said housing, said source vacuum chamber having an opening adapted for connection to a source of vacuum, said reduced vacuum chamber having an opening adapted for connection to a vacuum motor, said housing having an aperture leading to said reduced vacuum chamber from a source of air, the opposite side of said housing defining a valve seat surrounding said aperture, a plunger extending through said aperture and having one end secured to said diaphragm, and a cylindrical axially-flexible seal disposed about said plunger and having one end secured to the opposite end of said plunger, said plunger having a valve seat formed thereabout intermediate its ends and further having a port intermediate said plunger valve seat and the opposite end of said plunger and a passage extending from said port to said source vacuum chamber, the other end of said seal having inner and outer valve surfaces biased toward engagement with said plunger valve seat and said housing valve seat respectively, said diaphragm being biased toward said housing to thereby maintain the pressure in said reduced vacuum chamber at a predetermined differential greater than the pressure in said source vacuum chamber, whereby when the pressure in said reduced vacuum chamber exceeds the pressure in said source vacuum chamber by an amount greater than said differential said operating diaphragm moves said plunger and said seal to engage said outer valve surface with said housing valve seat and disengage said inner valve surface from said plunger valve seat to thereby connect said reduced vacuum chamber through said aperture, said port and said passage to said source vacuum chamber and thus reduce the pressure in said reduced vacuum chamber, and whereby when the pressure in said reduced vacuum chamber is less than the pressure in said source vacuum chamber plus said differential said operating diaphragm moves said plunger and said seal to disengage said outer valve surface from said housing valve seat and engage said inner valve surface with said plunger valve seat to thereby connect said reduced vacuum chamber through said aperture to said source of air and thus increase the pressure in said reduced vacuum chamber.

2. A vacuum reducer valve assembly comprising a housing, a cover, a diaphragm secured between said housing and said cover to define a source vacuum chamber between said cover and one side of said diaphragm and to define a reduced vacuum chamber between the opposite side of said diaphragm and one side of said housing, said source vacuum chamber having an opening adapted for connection to a source of vacuum, said reduced vacuum chamber having an opening adapted for connection to a vacuum motor, a closure member, a pressure responsive member secured between said closure member and said housing to define an atmospheric pressure chamber between the opposite side of said housing and one side of said pressure responsive member and an evacuated chamber between the opposite side of said pressure responsive member and said closure member, said housing having an aperture leading to said reduced vacuum chamber from said atmospheric pressure chamber, the opposite side of said housing defining a valve seat surrounding said aperture, a plunger extending through said aperture and having one end secured to said diaphragm and the opposite end engaging said pressure responsive member, a cylindrical axially-flexible seal disposed about said plunger and having one end secured to the opposite end of said plunger, said plunger having a valve seat formed thereabout intermediate its ends and further having a port intermediate said plunger valve seat and the opposite end of said plunger and a passage extending from said port to said source vacuum chamber, the other end of said seal having inner and outer valve surfaces biased toward engagement with said plunger valve seat and said housing valve seat respectively, said diaphragm being biased toward said housing to thereby maintain the pressure in said reduced vacuum chamber at a predetermined differential greater than the pressure in said source vacuum chamber, whereby when the pressure in said reduced vacuum chamber exceeds the pressure in said source vacuum chamber by an amount greater than said differential said operating diaphragm moves said plunger to engage said outer valve surface with said housing valve seat and disengage said inner valve surface from said plunger valve seat to thereby connect said reduced vacuum chamber through said aperture, said port and said passage to said source vacuum chamber and thus reduce the pressure in said reduced vacuum chamber, whereby when the pressure in said reduced vacuum chamber is less than the pressure in said source vacuum chamber plus said differential said operating diaphragm moves said plunger to disengage said outer valve surface from said housing valve seat and engage said inner valve surface with said plunger valve seat to thereby connect said reduced vacuum chamber through said aperture to said atmospheric pressure chamber and thus increase the pressure in said reduced vacuum chamber, and whereby said pressure responsive member controls the bias of said diaphragm toward said housing in accordance with the pressure in said atmospheric pressure chamber and thus varies said differential in accordance with atmospheric pressure.

3. A vacuum reducer valve assembly comprising a housing, a cover, a diaphragm secured between said housing and said cover to define a source vacuum chamber between said cover and one side of said diaphragm and to define a reduced vacuum chamber between the opposite side of said diaphragm and one side of said housing, said source vacuum chamber having an opening adapted for connection to a source of vacuum, said reduced vacuum chamber having an opening adapted for connection to a vacuum motor, said housing having an aperture leading to said reduced vacuum chamber from a source of air, the opposite side of said housing defining a valve seat surrounding said aperture, a plunger extending through said aperture and having one end secured to said diaphragm, said plunger having a valve seat formed thereabout and further having a passage extending past said plunger valve seat through a port from said reduced vacuum chamber to said source vacuum chamber, and a seal having inner and outer valve surfaces biased toward engagement with said plunger valve seat and said housing valve seat respectively, said diaphragm being biased toward said housing to thereby maintain the pressure in said reduced vacuum chamber at a predetermined differential greater than the pressure in said source vacuum chamber, whereby when the pressure in said reduced vacuum chamber exceeds the pressure in said source vacuum chamber by an amount greater than said differential said operating diaphragm moves said plunger to engage said outer valve surface with said housing valve seat and disengage said inner valve surface from said plunger valve seat to thereby connect said reduced vacuum chamber through said port and said passage to said source vacuum chamber and thus reduce the pressure in said reduced vacuum chamber, and whereby when the pressure in said reduced vacuum chamber is less than the pressure in said source vacuum chamber plus said differential said operating diaphragm moves said plunger and said seal to disengage said outer valve surface from said housing valve seat and engage said inner valve surface with said plunger valve seat to thereby connect said reduced vacuum chamber through said aperture to said source of air and thus increase the pressure in said reduced vacuum chamber.

* * * * *